United States Patent [19]

Magnusson et al.

[11] 4,392,052

[45] Jul. 5, 1983

[54] DEVICE FOR CARRYING ELECTRICAL RESISTANCE ELEMENTS

[75] Inventors: Bengt Magnusson, Hallstahammar, Sweden; Hans Gürtler, Roedermark, Fed. Rep. of Germany

[73] Assignee: Bulten-Kanthal AB, Hallstahammar, Sweden

[21] Appl. No.: 250,898

[22] Filed: Apr. 3, 1981

[51] Int. Cl.[3] ..... H05B 3/06

[52] U.S. Cl. ..... 219/532; 174/138 J; 219/390; 219/536; 338/315; 373/130; 373/133

[58] Field of Search ..... 13/25; 174/138 J; 338/315, 316, 317, 318, 319; 219/390, 532, 536, 537, 552; 373/5, 119, 128, 130, 132, 133, 137

[56] References Cited

U.S. PATENT DOCUMENTS

| | | | |
|---|---|---|---|
| 1,565,466 | 12/1925 | Keene | 373/130 |
| 1,638,822 | 8/1927 | Biebel | 373/130 |
| 1,695,874 | 12/1928 | Woodson | 373/130 |
| 1,947,612 | 2/1934 | Moore | 373/130 X |
| 2,020,127 | 11/1935 | Stansel | 373/130 |
| 2,417,953 | 3/1947 | Stupakoff | 373/114 X |
| 3,705,253 | 12/1972 | Hicks | 373/130 |
| 3,743,753 | 7/1973 | Petzi et al. | 373/130 |
| 3,987,237 | 10/1976 | Phillips et al. | 373/130 |
| 4,088,825 | 5/1978 | Carr | 373/130 |
| 4,154,975 | 5/1979 | Sander | 373/130 |
| 4,156,792 | 5/1979 | McFadden et al. | 373/130 |
| 4,233,468 | 11/1980 | Northup, Jr. | 373/128 |
| 4,298,311 | 10/1981 | Hagglund et al. | 219/464 |
| 4,337,390 | 6/1982 | Best | 219/532 |
| 4,363,959 | 12/1982 | Cottrell et al. | 219/532 |

*Primary Examiner*—Volodymyr Y. Mayewsky
*Attorney, Agent, or Firm*—Burns, Doane, Swecker & Mathis

[57] ABSTRACT

An apparatus replaceably carries an electrical resistance element for a furnace. The electrical element is of serpentine configuration having a plurality of U-shaped portions. At least one plate-shaped carrying element is mechanically fastened in a block of ceramic fibrous material. The carrying element includes a plurality of through-passages into which the U-shaped portions of the electrical element are inserted. The through-passages each include side walls and transverse walls which restrain movement of the electrical element in all directions except a direction in which the electrical element is inserted and removed. The carrying element is spaced from the adjacent curved segments of the U-shaped portions. The electrical element terminates in elongated terminals which are carried by a plug of fibrous ceramic material. The electrical element is situated within a recess of the ceramic block. The plug is sized to fit into an opening in the block on one side of the recess so as to close-off that opening simultaneously with the insertion of the electrical resistance element.

10 Claims, 16 Drawing Figures

DEVICE FOR CARRYING ELECTRICAL RESISTANCE ELEMENTS

BACKGROUND AND OBJECTS OF THE INVENTION

The present invention relates to an apparatus for carrying electrical resistance elements for furnaces. The apparatus is so designed that the elements can be replaced. The device also comprises a block of fibrous, ceramic material which simultaneously supports the resistance element and functions as insulation for the furnace or the like wherein the element is positioned.

Electrical resistance elements are, in some applications, operating at very high temperatures and can then become so soft that they are deformed by their own weight and also are affected by magnetic forces from neighboring elements. The elements are also susceptible to mechanical action, as these types of products are brittle at lower temperatures.

Devices for carrying these kinds of resistance elements are previously known, i.e., by German Pat. No. 1,942,645 and U.S. Pat. No. 4,154,975 and 4,088,825. In the German patent the resistance elements, usually U-shaped or hairpin-shaped, are horizontally insulated and placed upon a number of omega-shaped elements which, in turn, are carried by a carrying element, i.e., a tube of silicon carbide. The carrying element is then fastened on a brick in the furnace wall. To replace an element, the entire carrying device assembly must be removed from the furnace.

The resistance elements may also be serpentine-shaped with two or more shanks, wherein each single shank must be supported. It is important that the furnaces at the high temperatures, up to 1600° C., which may occur, are well insulated. Therefore, many modern furnace designs use insulation made from ceramic fibers, i.e., material marketed under the trademark FIBROTHAL.

SUMMARY OF PREFERRED EMBODIMENTS OF THE INVENTION

The present invention is for a device for carrying of electrical resistance elements in furnaces of different kinds insulated by fibrous materials such that the elements can be replaced when the furnace is being used and at a high temperature. The device can be used with elements which are either rods, U-shaped or serpentine-shaped and it also enables positioning the resistance elements well protected against mechanical action. The invention further combines the devices carrying the resistance elements with insulation material made from ceramic fibers. The invention can be applied on horizontally as well as vertically mounted resistance elements. The invention makes it possible to achieve a very high surface load of more than 50 kW installed power per square meter of fibrous material block surface exposed to the interior of the furnace, measured at working temperatures.

The above-mentioned advantages are achieved with a device according to the invention which is characterized in that it comprises a block of ceramic, fibrous material into which are mechanically fastened one or more plate-shaped carrying elements of refractory ceramic material, partly protruding from the fibrous material and having grooves or holes to carry the resistance elements. Preferably, the protruding parts are wholly or partly positioned in cavities in the fibrous material, whereby this material will partly surround the resistance elements and so protect them from mechanical action. The ceramic carrying elements are mechanically fastened in the fibrous material. This can be achieved by the geometrical shape of the carrying elements as well as by having one or more holes in those parts of the carrying elements which are inside the fibrous material. Each one of these holes has a rod passing through it at a right angle to the plate-shaped carrying element.

Preferably, the length of the rods is such that each rod, while entirely embedded in the fibrous material, passes through a hole of each carrying element of a fibrous block. The plate-shaped carrying elements protrude from the fibrous material with a shape able to carry one or more resistance elements which are rod-shaped, U-shaped or serpentine-shaped. Different from hitherto known designs, devices according to the invention, will allow for the resistance elements to be removed from the furnace without changing the position of the carrying elements. The carrying elements and the rods, if any, are embedded in the fibrous blocks when these are manufactured i.e. by vacuum forming.

It is also known, in the construction of furnaces with fibrous insulating material, to make use of blocks of fibrous material having incorporated electrical resistance elements. This arrangement, however, involves several disadvantages. One has not a free choice of material in forming the resistance elements, e.g., elements made from molybdenum disulfide cannot be used since it will react with the fibrous material, which cannot resist the high temperatures obtainable with such elements. Compared to furnace temperatures, the temperatures of the elements increase due to the insulating property of the fibrous material. It may finally be mentioned that the element cannot be replaced, but rather the complete fibrous block with the element has to be replaced if an element fails to function satisfactorily.

THE DRAWING

Hereafter, the invention will be closely described with reference to the drawings, in whcih:

FIG. 1 shows in perspective a a block of ceramic fibrous material holding a resistance element with two serpentine shanks. The element is positioned in the block by two plate-shaped carrying elements of high temperature-resistance refractory material. These are mechanically fastened into the fibrous block by two through-passing rods. The element can be removed from the block together with a plug of ceramic fibrous material;

DETAILED DESCRIPTION OF PREFERRED EMBODIMENTS OF THE INVENTION

Figure 1:
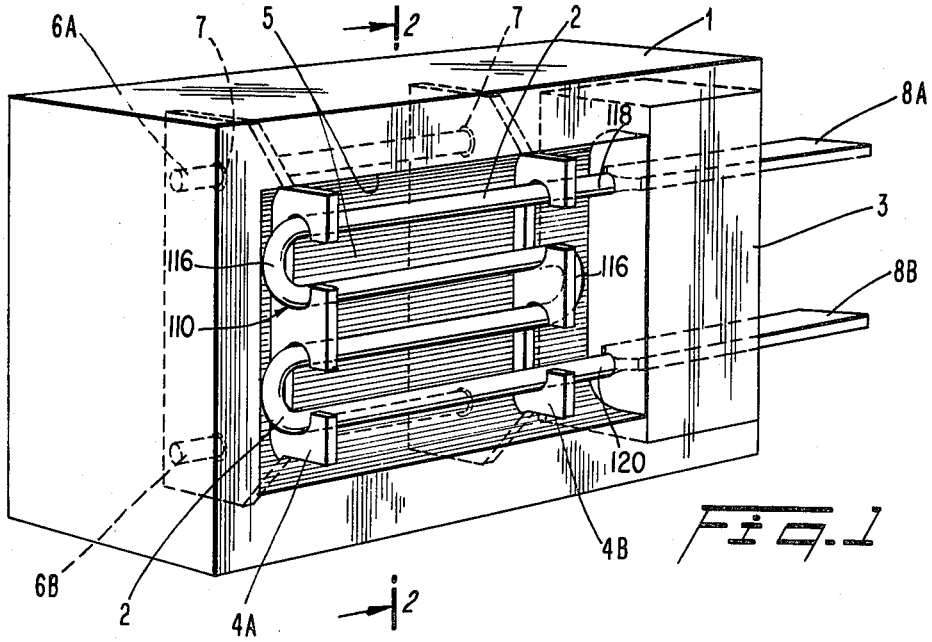

FIG. 1 shows a block of ceramic fibrous material 1 having a recess 5. Carrying elements 4A, 4B of high temperature resistant refractory material are fastened within the ceramic fibrous material and protrude therefrom into the recess 5. The portions of the carrying elements which are disposed in the fibrous material having holes 7 through which are positioned rods 6A, 6B. Those rods are embedded within the block 1. The carrying elements carry a dual-shank serpentine-shaped resistance element 2, preferably made from molybdenum disulfide. The terminals 8A, 8B of the element 2 extend through a plug 3 which is made of the same ceramic fibrous material as the block 1, and which block 3 fits with a slight friction fit in an enlargement of the recess 5. If the element 2 is to be replaced, it can be removed from the block together with the plug. In the embodiment of FIG. 1, the element 2 and plug 3 would be moved to the right relative to the carrying elements, i.e., perpendicular to the plane of such elements.

Figure 2:
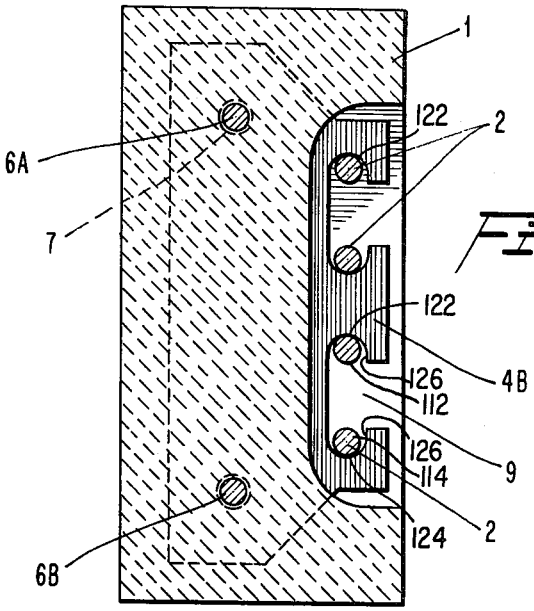
FIG. 2 is a cross-sectional view of the block depicted in FIG. 1.

FIG. 2 is a cross-sectional view of the unit shown in FIG. 1. FIG. 2 better shows how the shanks of the resistance element are positioned in cut-outs 9 in the ceramic carrying elements 4A, 4B.

The electrical element 2 has a plurality of U-shaped portions 110 defined by two straight shanks 112, 114 and curved segments 116 interconnecting the straight shanks. The end ones 118, 120 of the U-shaped portions terminate in the elongated terminals 8A, 8B, both of which extend toward the same side of the block, i.e., the side from which the electrical element is inserted. The U-shaped portions are arranged to open alternatively toward and away from that side of the block. The cut-outs or through-passages 9 each include side walls 122, 124 and transverse walls 126. The side walls 122, 124 oppose respective ones of the straight shanks 112, 114 of the associated U-shaped position 110 and thus restrain movement of the electrical element within the plane of the latter and transversely of the direction of insertion of the electrical element (i.e., to restrain movement to the right or left in FIG. 2). The transverse walls extend across the associated through-passages to prevent removal of the electrical element therefrom in a direction perpendicular to the plane of the electrical element. The carrying elements 4A, 4B are spaced from the adjacent curved segments of the U-shaped portions.

Figure 3:
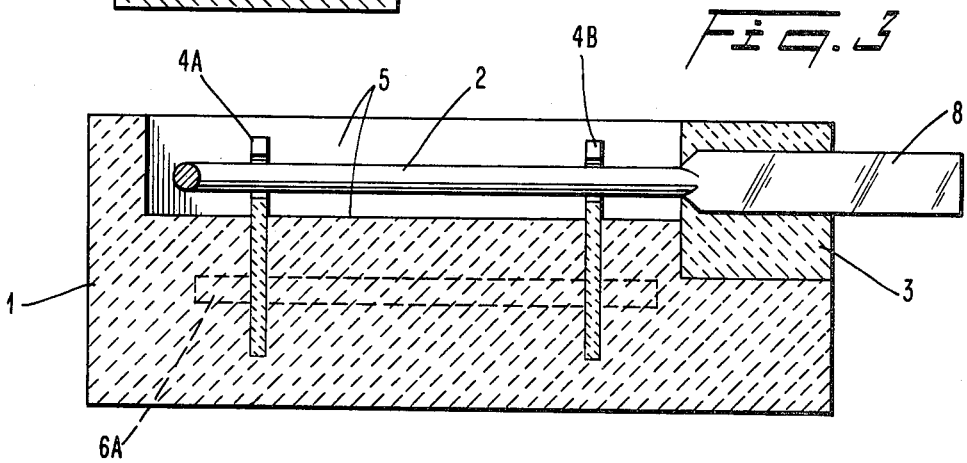
FIG. 3 is a cross-sectional view at a right angle relative to that of FIG. 2.

FIG. 3 is a cross-sectional view of the unit, but at a right angle relative to that of FIG. 2. In FIG. 3 the plug 3 has been removed for clarity.

Figure 4:
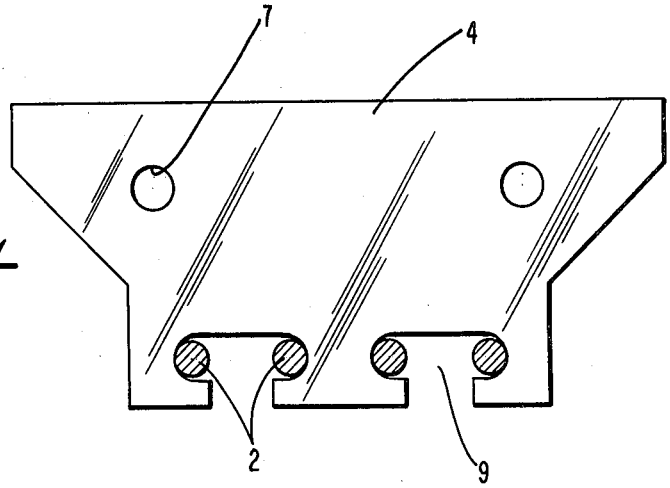
FIGS. 4, 5, 6 and 7 are side elevational views of different types of ceramic carrying elements.

FIGS. 4 through 7 show, respectively, different designs of the carrying elements. FIG. 4 shows a carrying element 4 of the kind which is used in the units of FIGS. 1–3. That carrying element is fastened in the ceramic fibrous material because of its shape (i.e., its enlarged mounting portion) as well as by rods 6 which can be inserted through the holes 7. Carrying elements of this kind can of course be designed for resistance elements having different numbers of shanks. For each shank there shall be one recess or cut-out 9 in the carrying element.

Figure 5:
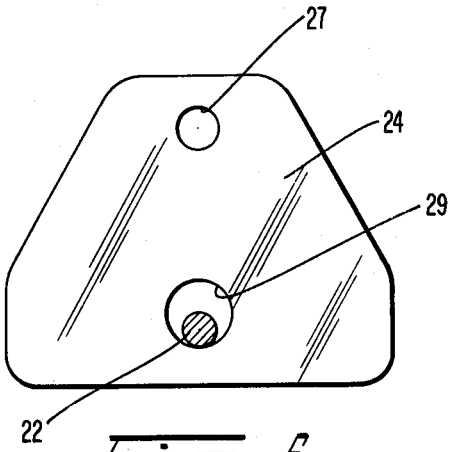

FIG. 5 shows a carrying element 24 intended for a straight, rod-shaped element 22 to be positioned in a cut-out 29 in the form of a circular hole. This carrying element, like the one shown in FIG. 6, is intended to be mechanically fastened in the ceramic fibrous material by rods passing through the holes 27.

Figure 6:
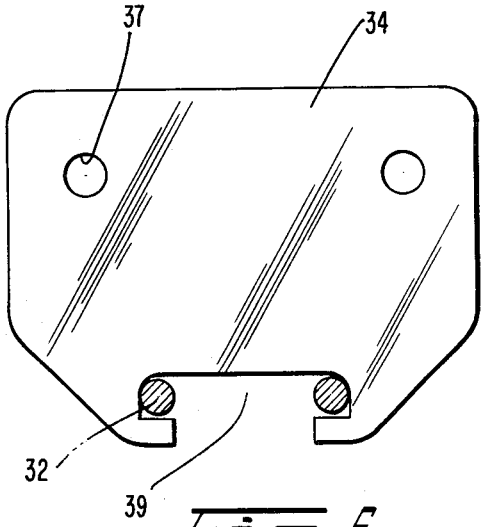

FIG. 6 shows a carrying element 34 intended for a U-shaped or hairpin-shaped resistance element 32, disposed in a cut-out 39. Retaining rods are to pass through the holes 37.

Figure 7:
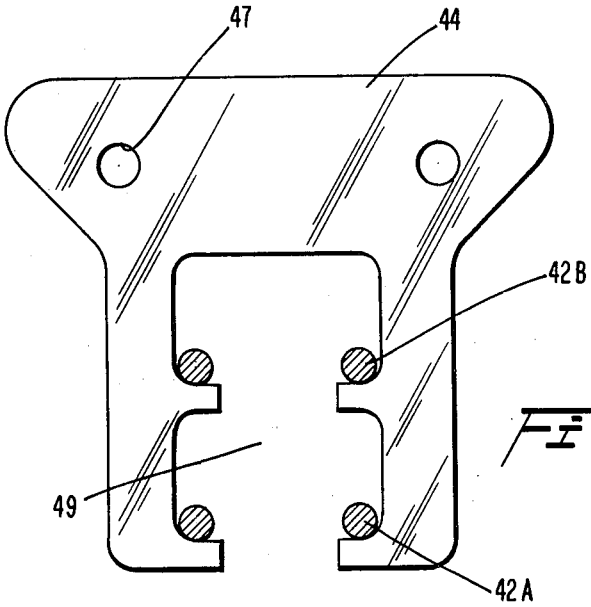

In FIG. 7 there is shown a carrying element 44 intended to carry two resistance elements 42A, 42B in a cut-out 49. It is, of course, possible to design the carrying elements correspondingly to carry three or more resistance elements but such designs are thought to be of little interest in practice. Retaining rods would pass through the holes 47.

Figure 8:
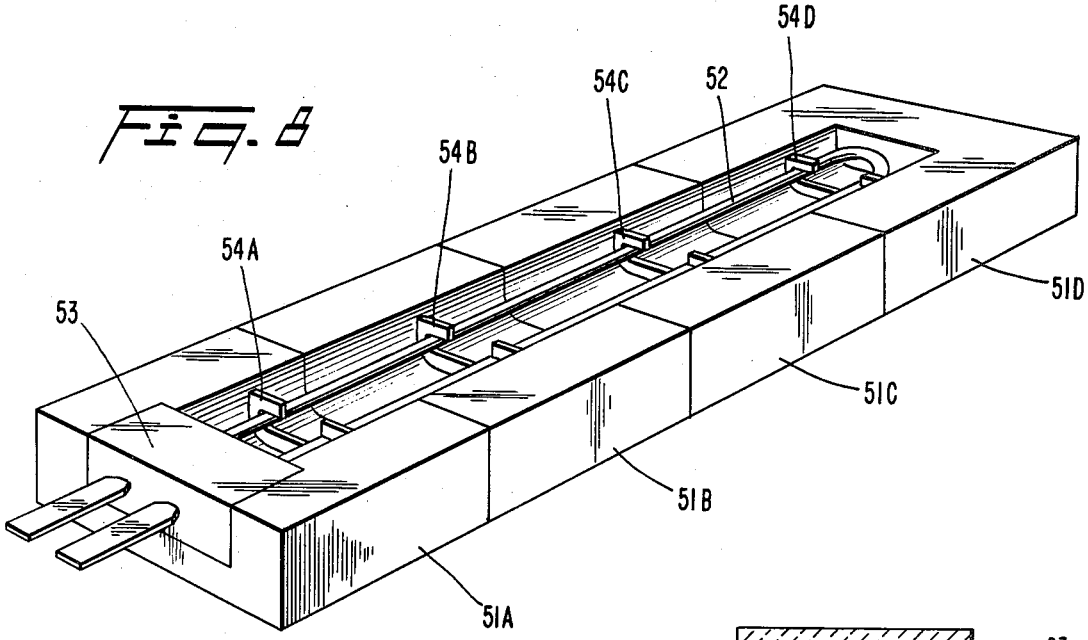
FIG. 8 shows in perspective an embodiment of the invention where the same element passes through several fibrous blocks.
Figure 9A:
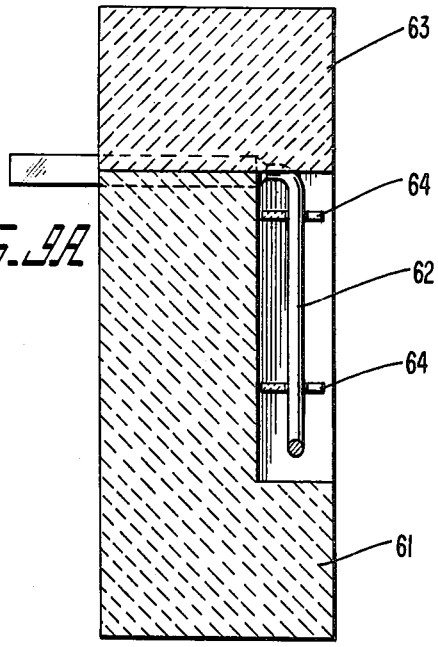
FIG. 9A shows in side view an embodiment where the terminals are at a 90° angle relative to the glowing zone of the element.
Figure 9B:
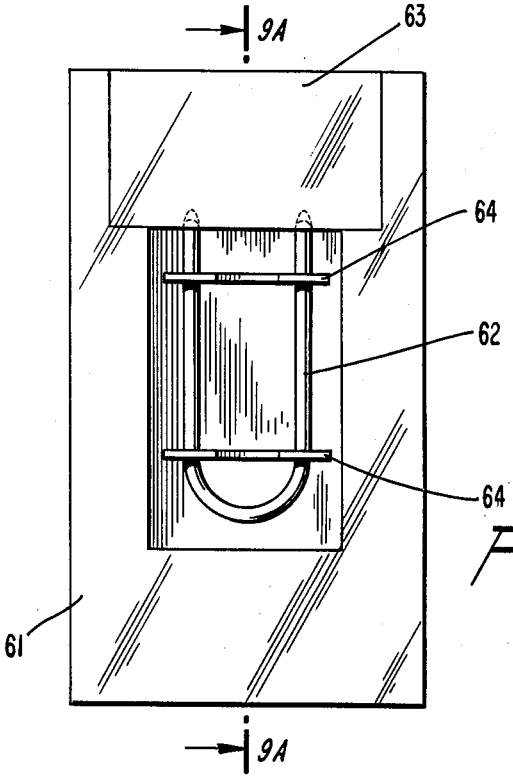
FIG. 9B is a front view of the embodiment depicted in FIG. 9A.

FIG. 8 shows a device according to the invention where a single resistance element 54 is carried by four separate blocks of ceramic fibrous material having carrying elements of high temperature resistant refractory ceramic fastened in the blocks. In the embodiment shown in the figure, each of the four blocks 51A–51D has one carrying element 54AA–54D. Of course, each block may have several such carrying elements. The two middle blocks are identical. The first block 51A is equipped with a removable plug 53 to make possible replacement of the element as previously described. The last block 51D has a recess which does not extend for the full length of the block.

The dimensions of devices according to the invention may vary, depending upon the particular application. However, the length of a single fiber block taken in a direction parallel to that of the resistance elements will, as a rule, be 0.3–1.0 meter. The diameter of the resistance element is mostly in the range of 3–15 mm and their length may vary from 0.1 m, up to several meters. Serpentine-shaped elements may have different numbers of serpentine shanks.

Figure 10:
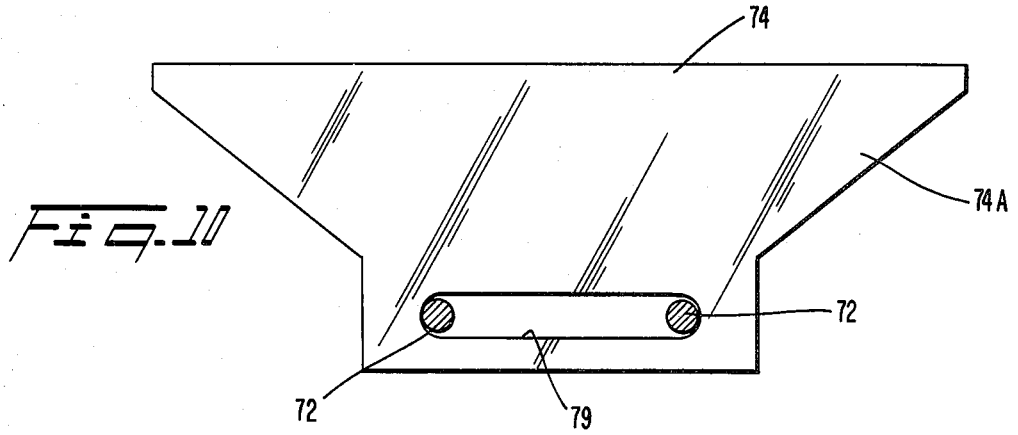
FIG. 10 is a side elevational view of another form of carrying element which can be employed in accordance with the present invention.

In FIG. 10 an alternative form of carrying element 74 is disclosed wherein a through-passage 79 is provided for receiving a U-shaped resistance element 72. An enlarged portion 74A of the carrying element would be embedded within a ceramic block (not shown).

Figure 11:
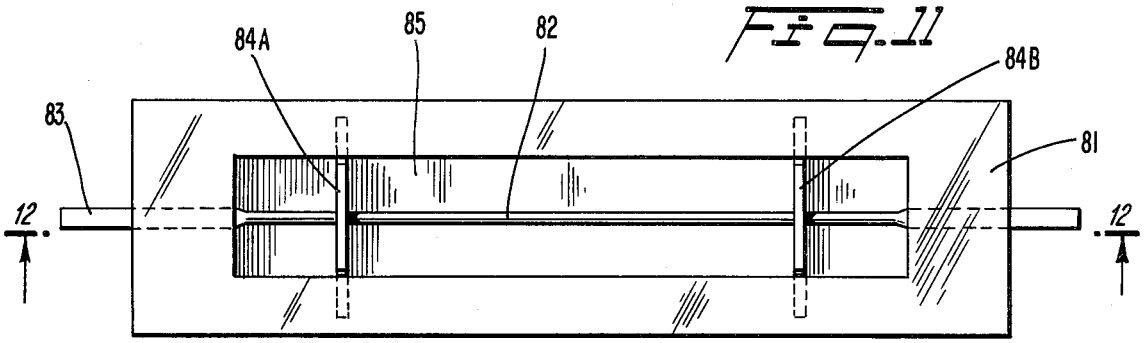
FIG. 11 is a front view of a modified form of block, carrying element, and resistance element in accordance with the present invention.
Figure 12:
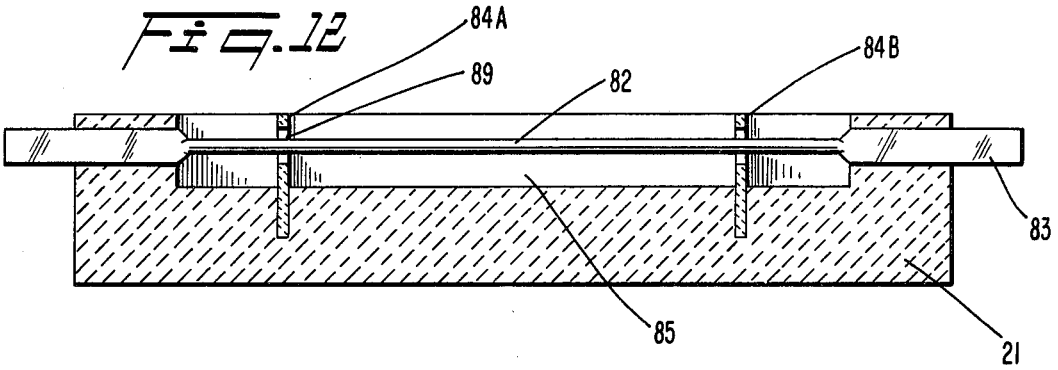
FIG. 12 is a longitudinal sectional view taken along line 12—12 in FIG. 11.
Figure 13:
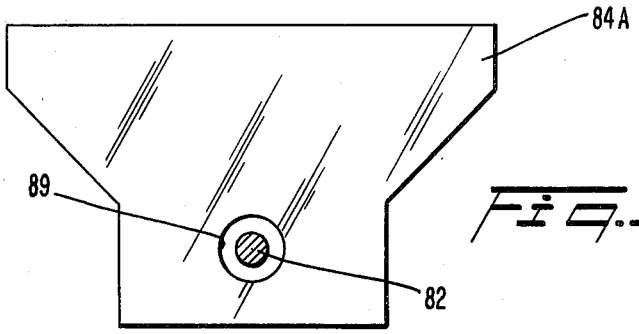
FIG. 13 is a side elevational view of a carrying element of the type depicted in FIG. 11.

In FIGS. 11 and 12, there is depicted in front view, a ceramic block 81 in which a pair of carrying elements 84A, 84B are embedded, the carrying elements being depicted in FIG. 13. A single resistance element 82 is insertable and removable relative to circular openings 89 within the carrying elements. The carrying elements are embedded within the block 21 without the need for rods 6 of the type previously disclosed.

Figure 14:
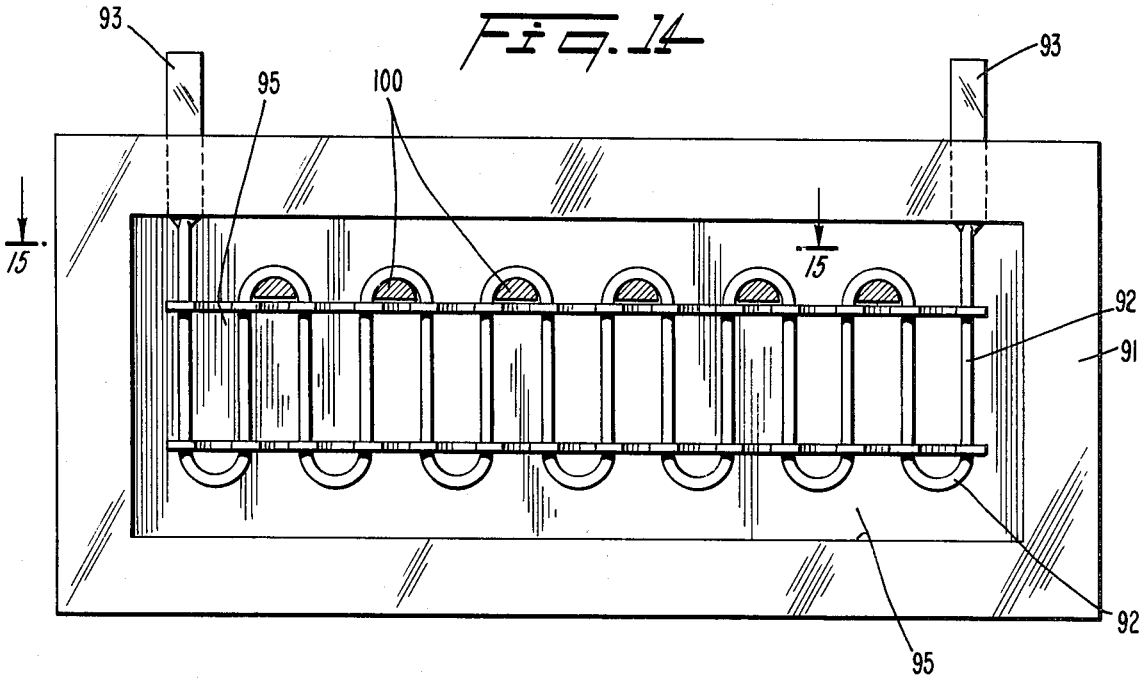
FIG. 14 is a front view of still another preferred embodiment in accordance with the present invention.

In FIG. 14 there is depicted a further embodiment of the invention wherein a serpentine type of resistance element 92 is vertically insertable into a recess 95 of a fibrous ceramic block 91. Ceramic plugs 93 are mounted at the ends of the resistance element and are received within corresponding openings of the block 91.

Figure 15:
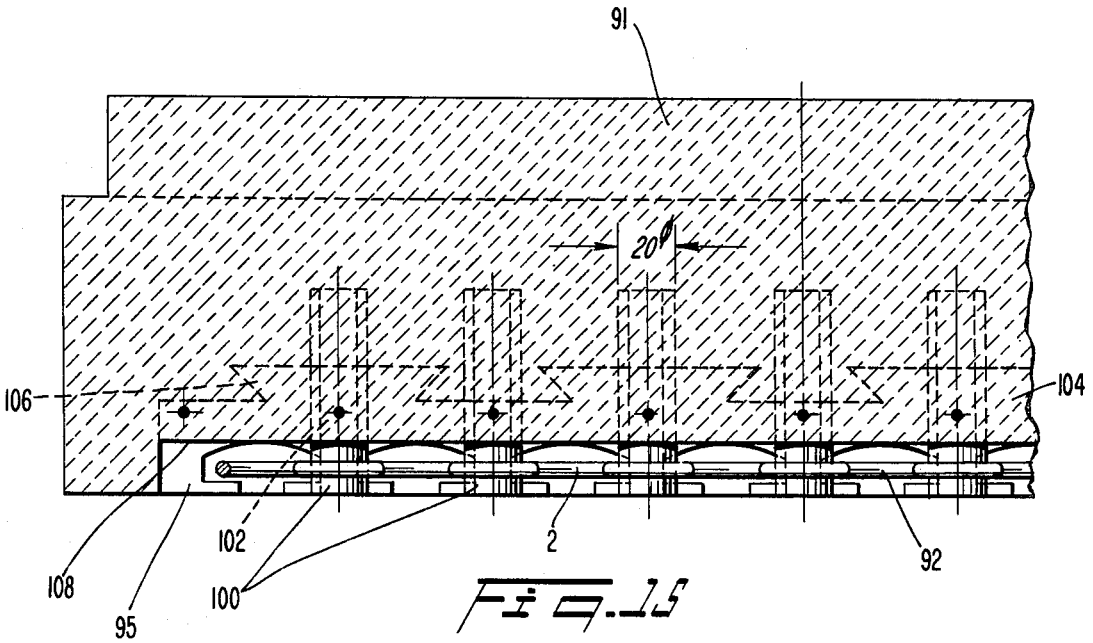
FIG. 15 is a horizontal sectional view taken along a horizontal plane through the assembly depicted in FIG. 14.

Projecting horizontally from the block and into the recess 95 are a plurality of ceramic support members 100. The support members 100 are spaced by a distance corresponding to the facing between adjacent peaks of the serpentine resistance element, such that when the resistance element is inserted vertically into the recess 95, the valleys of the resistance element pass between the supports 100 and the peak portions of the resistance element rest against the support. The supports 100 are carried at the end of threaded mounting shanks 102 (FIG. 15) which are threadedly inserted within the block. The block includes an adapter plate 104 having a dove-tail connection with the block. The mounting shanks are threaded through the adapter plate 106 and into the block 91. An outer wall 108 of the adapter plate forms the inner wall of the recess 95.

By virtue of the manner in which the resistance element is retained in accordance with the present invention , the heating power which can be installed to the resistance element is substantially greater than that previously possible. Former limits of about 2 $W/cm^2$ of block surface have now been extended to 7 $W/cm^2$ of block surface as a result of the present invention.

Besides the herein given examples of embodiments of the invention, there may thus be a great number of varieties within the scope of the invention.

What is claimed is:

1. Apparatus replaceably carrying an electrical resistance element for a furnace, comprising:

a block of ceramic fibrous material, said electrical resistance element being mounted on said block and being of serpentine configuration having a plurality of adjacent generally U-shaped portions defined by straight shanks and curved segments interconnecting said straight shanks, the end ones of said U-shaped portions terminating in elongated terminals extending toward a common side of said block from which said electrical resistance element is inserted, said U-shaped portions being arranged to open alternately toward and away from said common side, at least one plate-shaped carrying element of electrically insulative material mechanically fastened in said block and including a portion protruding from said block, said protruding portion including a plurality of through-passages into which can be slidably inserted said U-shaped portions which open toward said common side, said through-passages each including side wall means and transverse wall means, said side wall means of each through-passage being arranged opposite the respective straight shanks of the associated U-shaped portion to restrain movement of said electrical resistance element within its own plane and transversely of the direction of insertion and removal of said electrical resistance element, said transverse wall means extending across the associated through-passages to prevent removal of said electrical resistance element from said through-passages in a direction perpendicular to said plane, said at least one plate-shaped carrying element being spaced from the adjacent curved segments of said U-shaped portions.

2. Apparatus according to claim 1, wherein there are a plurality of said plate-shaped carrying elements, the through-passages of each said carrying elements being aligned with the through-passages of the other of said carrying elements, each of said carrying elements being spaced from the respective curved segments of said electrical resistance element.

3. Apparatus according to claim 1, wherein said block forms a recess in which said electrical resistance element is disposed, and a plug formed of fibrous ceramic material and carrying said terminals of said electrical resistance element, said plug being sized to fit into an opening in said recess in said common side of said block so as to close-off said opening simultaneously with the insertion of said electrical resistance element.

4. Apparatus according to claim 1, wherein said block includes a recess, said protruding portion extending into said recess.

5. Apparatus according to claim 4, wherein said resistance element is disposed entirely within said recess.

6. Apparatus according to claim 1, wherein the installed power is at least 50 $kW/m^2$ of fibrous block surface exposed to the furnace compartment.

7. Apparatus according to claim 1, wherein said carrying element includes a mounting portion which is flared outwardly relative to said protruding portion and is embedded within said block.

8. Apparatus according to claim 1, wherein said carrying element is threadedly mounted within said block.

9. Apparatus according to claim 8, wherein said block includes an adapter plate mounted to a main portion of said block by a dove-tail connection, said carrying elements being threadedly mounted through said adapter plate and said main portion of said block.

10. Apparatus replaceably carrying an electrical resistance element for a furnace, comprising:

a block of ceramic fibrous material forming a recess, said electrical resistance element being mounted on said block and within said recess, said electrical resistance element having at least one generally U-shaped portion terminating in a pair of elongated terminals, at least two plate-shaped carrying elements of electrically insulative material mechanically fastened in said block and each including a portion protruding from said block and disposed in said recess, each protruding portion including at least one through-passage, a through-passage of each carrying element being aligned with a through-passage of the other carrying element so that said U-shaped portion can be inserted into and removed from said aligned through-passages in a direction parallel to said aligned through-passages, and a plug formed of fibrous ceramic material and carrying said terminals of said electrical resistance element, said plug being sized to fit into an opening in said block on one side of said recess so as to close-off said opening simultaneously with the insertion of said electrical resistance element.

* * * * *